US007611403B2

(12) United States Patent
Wenger

(10) Patent No.: US 7,611,403 B2
(45) Date of Patent: Nov. 3, 2009

(54) METHOD AND APPARATUS FOR A VENTILATION SYSTEM

(75) Inventor: Curtis Wenger, Goshen, IN (US)

(73) Assignee: CTB, Inc., Milford, IN (US)

( * ) Notice: Subject to any disclaimer, the term of this patent is extended or adjusted under 35 U.S.C. 154(b) by 140 days.

(21) Appl. No.: 11/273,341

(22) Filed: Nov. 14, 2005

(65) Prior Publication Data

US 2006/0105696 A1 May 18, 2006

Related U.S. Application Data

(60) Provisional application No. 60/628,153, filed on Nov. 15, 2004.

(51) Int. Cl.
*F24F 7/06* (2006.01)
*F24F 7/00* (2006.01)
*F24F 13/08* (2006.01)

(52) U.S. Cl. ..... 454/338; 454/259; 454/353; 415/147

(58) Field of Classification Search ..... 454/254, 454/257, 259, 270, 271, 338, 351, 353, 227, 454/359; 415/147, 219.1, 222, 224.5
See application file for complete search history.

(56) References Cited

U.S. PATENT DOCUMENTS

| | | | | |
|---|---|---|---|---|
| 2,055,592 | A * | 9/1936 | Roed | 454/329 |
| 2,489,446 | A * | 11/1949 | Biancani | 454/351 |
| 2,912,920 | A * | 11/1959 | Coe | 454/342 |
| 3,308,744 | A * | 3/1967 | Schach | 454/304 |
| 3,895,650 | A * | 7/1975 | Cadiou | 137/875 |
| 4,094,336 | A | 6/1978 | Urschel et al. | |
| 4,336,749 | A | 6/1982 | Barnhart et al. | |
| 4,353,680 | A * | 10/1982 | Hiraoka et al. | 415/222 |
| 4,372,196 | A * | 2/1983 | Henderson | 454/349 |
| 4,406,216 | A * | 9/1983 | Hott et al. | 454/349 |
| 4,594,940 | A | 6/1986 | Wolbrink et al. | |
| 4,986,469 | A * | 1/1991 | Sutton, Jr. | 236/49.3 |
| 5,236,391 | A | 8/1993 | Schaefer | |
| 5,336,131 | A * | 8/1994 | Crider et al. | 454/238 |
| 5,535,804 | A * | 7/1996 | Guest | 160/180 |
| 5,538,074 | A * | 7/1996 | Meyer | 165/96 |
| 5,567,200 | A * | 10/1996 | Swartzendruber | 454/338 |
| 5,924,922 | A | 7/1999 | Eakin et al. | |
| 6,378,322 | B1 * | 4/2002 | Calvert | 62/314 |
| 6,386,828 | B1 | 5/2002 | Davis et al. | |
| 6,616,404 | B1 | 9/2003 | Davis et al. | |
| 2003/0060155 | A1 * | 3/2003 | Baumgartner et al. | 454/341 |

OTHER PUBLICATIONS

CHORE-TIME Equipment, "48" and 52" Hyflo™ Fans Installation and Operators Instruction Manual", Jul. 2003.
Kolowa 1 Brochure, available at least by Mar. 6, 2004.
Kolowa 2 Brochure, available at least by Mar. 6, 2004.
DEL-AIR Systems, Northwind Fans, Mar. 1999.

* cited by examiner

*Primary Examiner*—Steven B McAllister
*Assistant Examiner*—Patrick F. O'Reilly, III
(74) *Attorney, Agent, or Firm*—Harness, Dickey

(57) ABSTRACT

A method and apparatus for providing ventilation to a selected structure. The apparatus may include various features such as flexible portions, rigid portions, and assembly portions. Further, various steps may be used to form the structure to achieve selected results, such as monolithic formation, inclusion of various positioning members, and the like.

38 Claims, 10 Drawing Sheets

METHOD AND APPARATUS FOR A VENTILATION SYSTEM

CROSS-REFERENCE TO RELATED APPLICATIONS

This application claims the benefit of U.S. Provisional Application No. 60/628,153, filed on Nov. 15, 2004. The disclosure of the above application is incorporated herein by reference.

FIELD

The present teachings relate to ventilation systems, and particularly to housings for fans operable to be mounted in structures.

BACKGROUND

Various structures may use ventilation systems to maintain a selected environment. For example, office buildings that may have sealed windows yet house large groups of people generally include ventilation systems including a heating and cooling system. The ventilation systems ensure that a supply of fresh air and acceptable levels of various materials are maintained within the structure. Further, the ventilation system can assist in removing less desirable compounds, such as carbon dioxide emitted by the inhabitants from the building. Therefore, the ventilation system may be used to move volumes of air and may generally include various fan systems to move the air.

Other structures, such as farmhouses, may also require ventilation systems. Farmhouses may be any appropriate building generally used in the production or carrying out of farming activities. For example, farmhouses may include buildings used to house and/or brood chickens, house pigs, or other livestock. Generally, these farmhouses may cover a selected square footage to allow for collecting a selected number of the livestock in a selected area for various purposes, such as growth, brooding, culling and the like. These farmhouses may generally be sealed or substantially closed structures to ensure the ability to obtain a tightly controlled environment therein. The ventilation systems, therefore, may play a role in maintaining the selected environment. For example, the ventilation systems may assist in removing various by-products, such as respiration gases and gases emitted by animal waste, from the structure to ensure a clean supply of air, assist in maintaining a selected temperature in the farmhouse. Therefore, achieving maximum efficiency of the ventilation system may be desirable.

Although providing an efficient and easy to use system may be desirable, many systems are complex and require multiple pieces to be assembled for use. Further, various systems may define housings around a selected ventilation system, such as fan, that have numerous pieces that are manufactured individually and assembled at a worksite into the farmhouse. The housings or structures may be substantially rigid and require augmentation of the farmhouse rather than be adaptable to the farmhouse. Alternatively, a plurality of sizes, structures, or shapes may be required to be produced for installation into a substantial majority of the various farmhouses.

SUMMARY

A fan may be a part of a ventilation system to control a part of an environment in a farmhouse. The fan may be used to move a selected volume of air at a selected rate, such as cubic feet per minute (cfm) to assist in removing selected gases from a farmhouse environment and introduce other selected gases into a farmhouse environment. For example, a fan may be used to move the respiration gases produced by the livestock kept in a farmhouse and replace it with atmospheric air. The fan system may include a housing that may be formed in a substantially monolithic or single piece. The monolithic fan housing may include a housing for the fan, back draft damper doors, and a support for the doors.

The doors may assist in maintaining a low or non-existence airflow through the farmhouse at selected times. Further, the fan housing may have integrally or monolithically formed therewith, or attached thereto, a diffuser that may assist in creating a selected efficient airflow or rate. The diffuser, however, may be formed of a different material or of a material that is substantially flexible. Therefore, the diffuser may have a formed size but may be flexed during installation to achieve an installation into substantially many positions without substantially decreasing the efficiency of the diffuser or requiring multiple different diffuser sizes for installation in various applications. Also, the back draft doors may be assembled and operated with a door operating system to open the doors to achieve a maximum or high efficiency airflow position when the fan is operating and substantially close the doors when the fan is not operating.

Further areas of applicability of the present teachings will become apparent from the description provided hereinafter. It should be understood that the description and various examples, while indicating the various embodiments of the teachings, are intended for purposes of illustration only and are not intended to limit the scope of the teachings.

BRIEF DESCRIPTION OF THE DRAWINGS

The present teachings will become more fully understood from the detailed description and the accompanying drawings, wherein.

DETAILED DESCRIPTION OF VARIOUS EMBODIMENTS

The following description of various embodiments is merely exemplary in nature and is in no way intended to limit the teachings, its application, or uses. Although the following teachings relate generally to a ventilation system used in a farmhouse, the system may be used in any appropriate application.

Figure 1A:
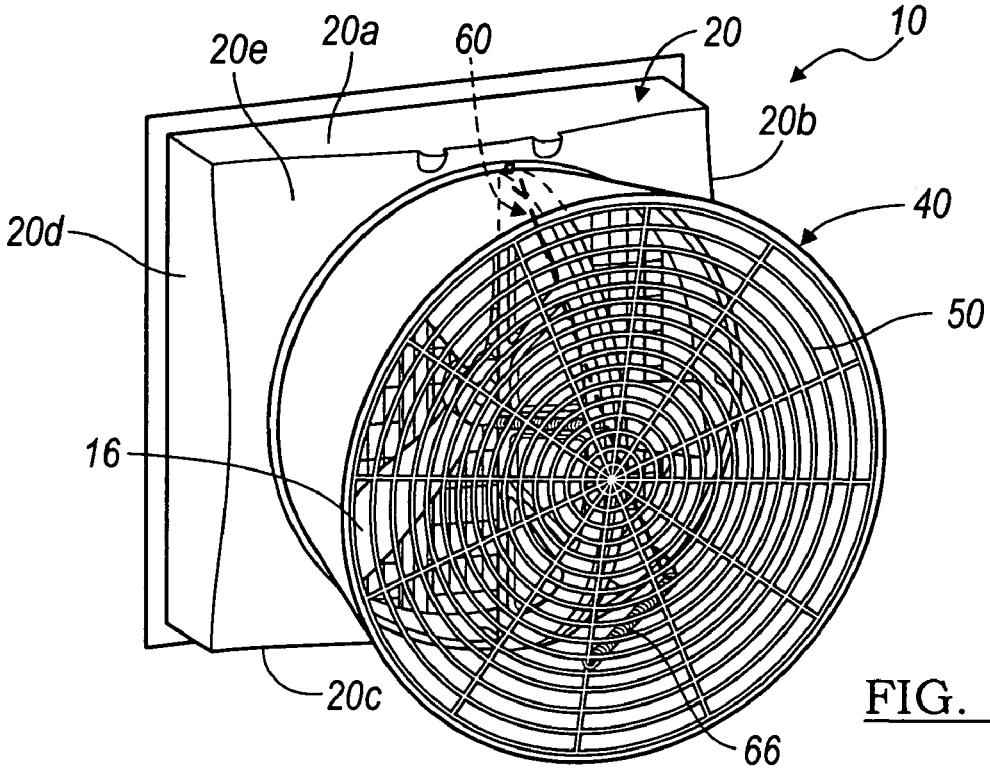
FIG. 1A is a fan assembly according to various embodiments.
Figure 1B:
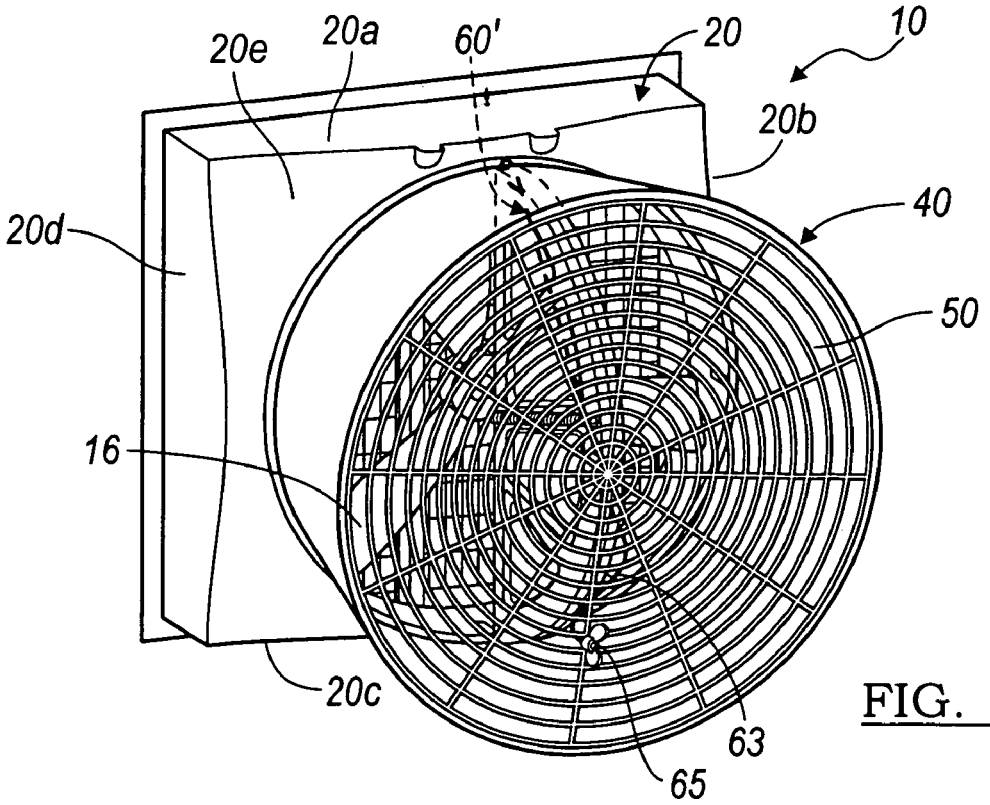
FIG. 1B is a fan assembly with a door positioning system according to various embodiments with the doors open.
Figure 2:
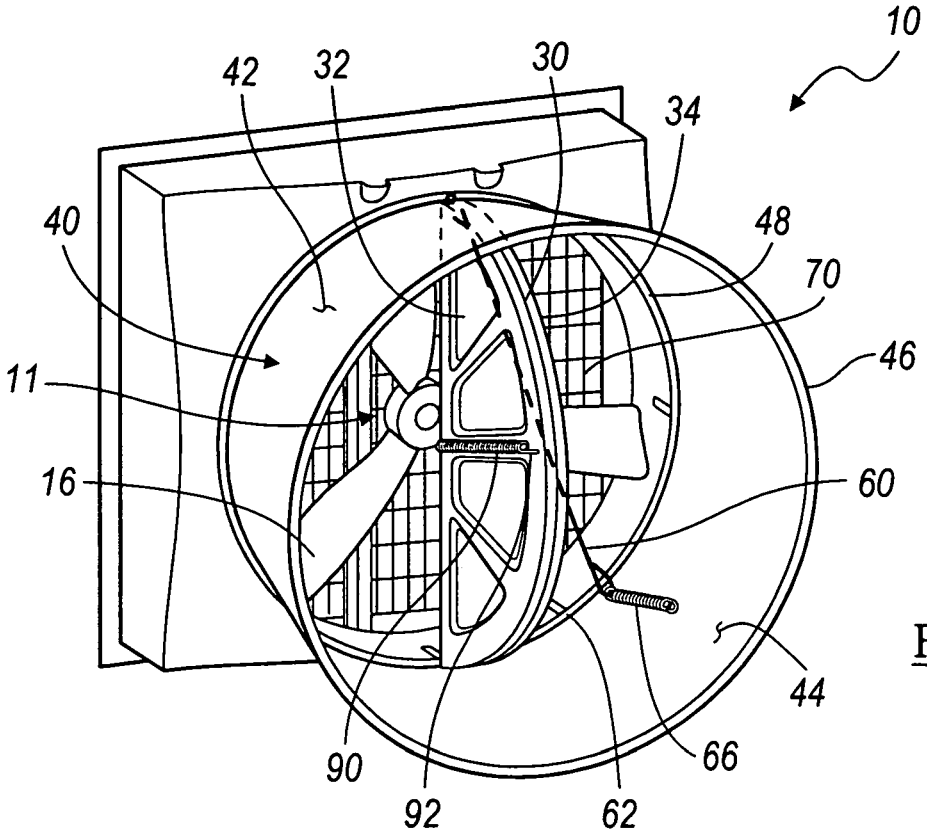
FIG. 2 is a fan assembly according to various embodiments without an exterior grille.
Figure 4:
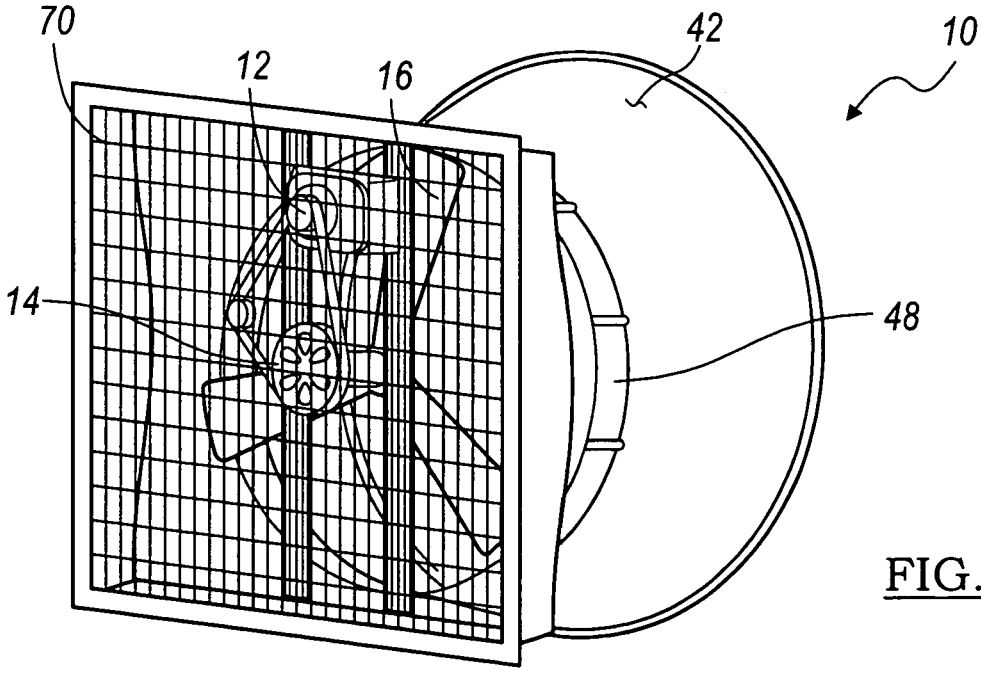
FIG. 4 is a perspective view of a fan assembly from an inlet side.

With reference to FIGS. 1, 2 and 4, a ventilation assembly 10 is illustrated. The ventilation assembly 10 includes a fan portion or assembly 11 including a fan motor 12, a fan axle 14 and a plurality of fan blades 16. The fan portion 11 generally provides the motive force to move a selected volume of air at a selected rate. It will be understood that the amount of air movable by the fan portion 11 may be dependent upon the power of the fan motor 12, the size and orientation of the fan blade 16 and other various portions. Regardless, it will be understood that the ventilation assembly 10 may be formed to any appropriate size, configuration and the like according to various embodiments.

Regardless, the ventilation assembly 10 usually includes a fan housing 20. The fan housing 20 may be designed in any appropriate configuration, size, and the like. The fan housing 20 may be substantially square or rectangular such that it may be installed in a structure including substantially vertically parallel studs or support portions. Therefore, the fan housing 20 may generally include four sidewalls 20*a*, 20*b*, 20*c*, and 20*d*. The four sidewalls 20*a*-20*d* provide an exterior support for a front or outlet sidewall 20*e*. The outlet sidewall 20*e* generally defines an area substantially equivalent to an area defined by the various sidewalls 20*a*-20*d* and can also include a selected geometry to provide for various characteristics. For example, the sidewalls 20*a*-20*e* may be designed to create a substantially efficient airflow from the fan portion 11. Further, the housing 20 is provided to support and may protect the fan portion 11 from various exterior environments such as weather, pests, and the like.

Figure 3A:
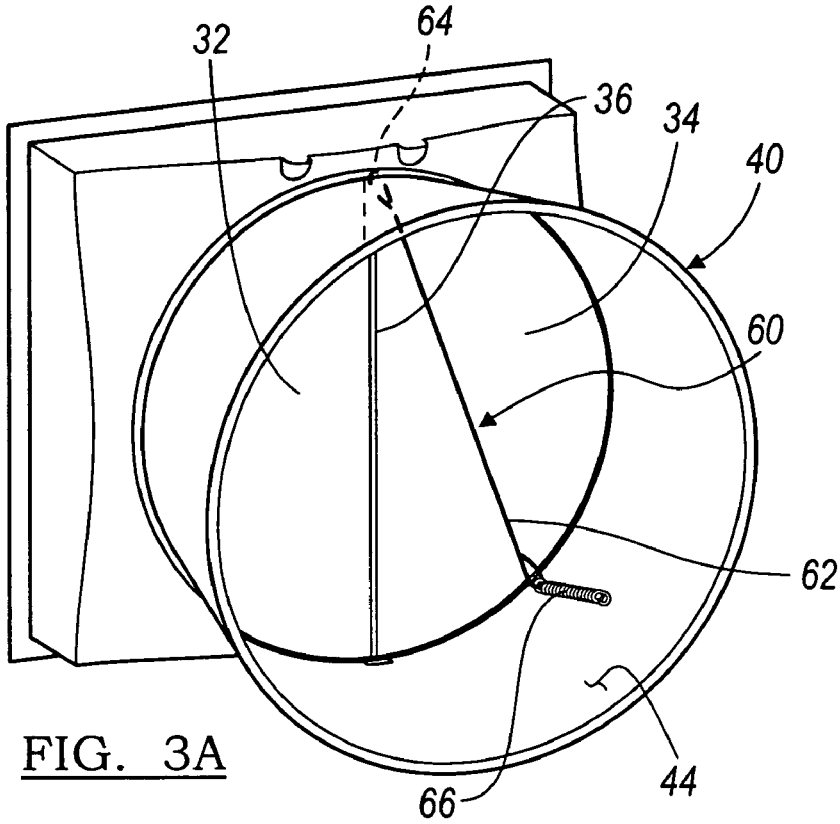
FIG. 3A is a fan assembly with back draft doors closed and no flow grille according to various embodiments.

The fan housing assembly 20 may also include a set of doors 30. The doors 30 may include a first door 32 and a second door 34 that are operable to close and substantially cover an opening defined by the fan housing 20 as illustrated in FIG. 3. The doors 30 may generally be assembled on a hinge that may be interconnected or extend from the support structure 36 that is defined as a portion of the fan housing 20. The fan housing 20 including the doors 30 and the support structures 36 may be formed substantially monolithically as described herein. Alternatively, the doors 30 may be formed separately and integrated into the fan housing 20 at a later time, such as at the time of the installation of the fan housing 20. Regardless, the back draft doors 30 may be provided to cooperate with the remaining portions of the housing 20 to substantially cover an opening to limit flow of air relative to the fan portion 11.

Further assembled or integrated with the housing 20 may be a diffuser 40. The diffuser 40 may include an exterior surface 42 and an interior surface 44. The interior surface 44 may be designed to assist in the aerodynamics of the fan portion 11 in moving the air in a selected direction. Generally, the diffuser 40 is provided on a downstream side of the fan 11. Therefore, a flow of air is through an external outlet mouth side 46 of the diffuser. The inlet side of the diffuser 48 is generally affixed to the fan housing 20. The diffuser 40 may be connected to the fan housing 20 in any appropriate manner. For example, a plurality of fastening members may be used to interconnect the diffuser 40 and the housing 20. Alternatively, or in combination thereto, a compression band or member may be used to interconnect the diffuser 40 with the fan housing 20. Alternatively, the diffuser 40 may be substantially monolithically formed with the housing 20. Therefore, it will be understood that the diffuser 40 may be formed with the housing 20 in any appropriate manner and may be a separate piece or formed substantially monolithically therewith.

The diffuser 40 may also be connected with a grille or cover 50. The grille 50 may allow air to flow through, but not allow large objects into the diffuser 40. The grille 50 may generally be positioned near the outlet end 46 of the diffuser 40 to assist in maintaining a substantially open airway through the diffuser 40.

Nevertheless, the doors 30 including the doors 32, 34, may open into the area defined by the diffuser 40. The doors 30 opening allows for air or other gasses to pass through the diffuser 40 when the fan system 11 is activated. As discussed herein, air pressure from air flowing through the outlet end 46 of the diffuser 40 may cause the doors 30 to open. As the doors 30 open into the area defined by the diffuser 40, a door holding or positioning mechanism 60 may interact with the doors 30 to limit movement or select a range of movement of the doors 30. The positioning system 60 may include a door positioning member 62, such as a wire, rigid rod, etc., that is interconnected with the door support 36 at a connection area or ring 64. It will be understood that the door positioning member 62 may be connected at any appropriate portion and may also be interconnected with the diffuser 40. As discussed above, if the diffuser 40 is separate from the fan housing 20, the door positioning system 60 may be substantially contained within the diffuser and easily removed from the fan housing 20. The door positioning member 62 can be further interconnected with the grill 50 with a spring or flexible member 66. Again, the flexible member 66 may also be interconnected with any appropriate portion of the diffuser 40 and may be connected with a wall of the diffuser 40. Therefore, the door positioning system 60 may be substantially completely formed or held within the diffuser 40 to allow for ease of removal and operation of the ventilation system 10.

The door positioning system 60 can be provided according to various embodiments. As discussed above, and further herein, the door positioning member 62 can be interconnected with a grate 50 of the ventilation system 10 with any appropriate member, such as the flexible member 66. It will be understood, however, that any appropriate door positioning system, according to various embodiments, can be provided.

Figure 3B:
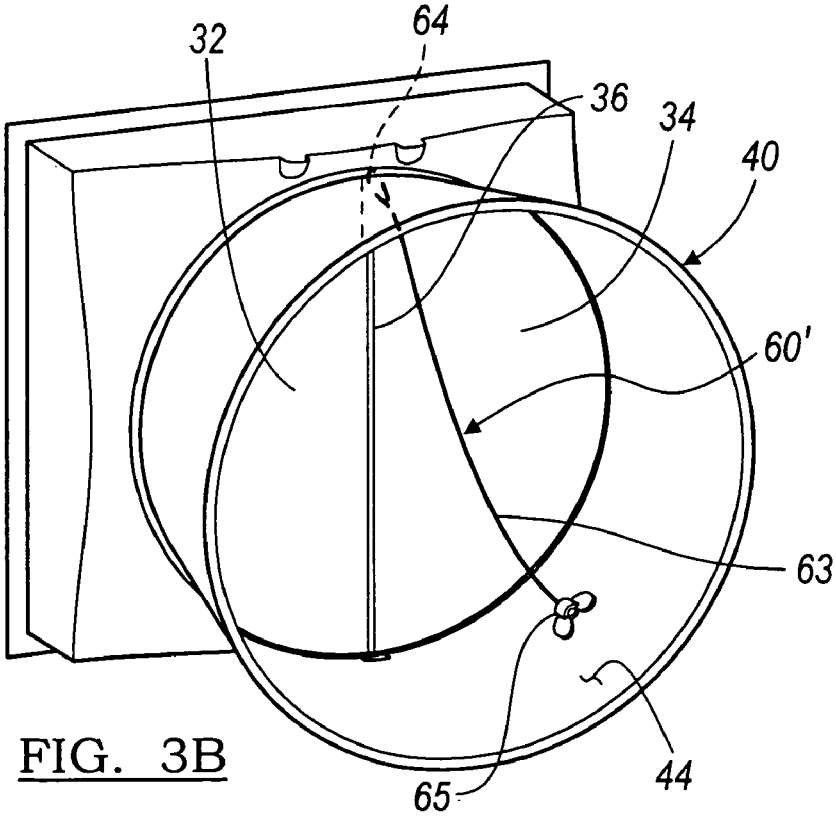
FIG. 3B is a fan assembly with a door positioning system according to various embodiments with the doors closed.
Figure 5:
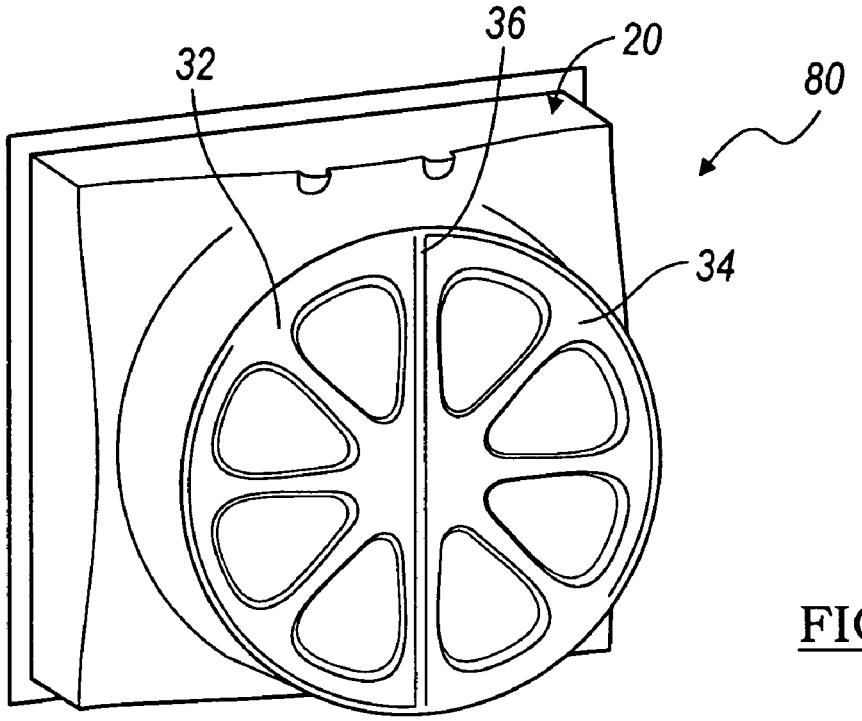
FIG. 5 is a perspective view of the monolithic form of the housing and back draft doors in support according to various embodiments.

With reference to FIGS. 1B and 3B, a door positioning system 60' can be provided. The door positioning system 60' can include a flexible or non-rigid door positioning member 63. The non-rigid door positioning member 63 can be any appropriate member such as a string, a flexible cable, a polymer cable or the like. It will be understood that the door positioning member 63 can be interconnected with the grate 50 in any appropriate manner, such as with a holding or locking nut or member 65. The holding member 65 can hold the door positioning member 63 relative to the grate 50 in any appropriate manner. The door positioning member 63 can be otherwise interconnected with the ventilation system 10 in any appropriate manner. As illustrated in FIG. 1B, the door positioning member 63 can be positioned between the doors 30 when they are in an open position. The doors 30 can, however, move relative to the ventilation system 10 due to the substantially non-rigid door positioning member 63. Further, the door positioning member 63 may include a length that is greater than a distance between an origin and the holding member 65 or the position of the holding member 65. Therefore, the doors 30 can move relative to the ventilation system 10, as discussed herein, to maintain a position of minimum or selected flow resistance.

Therefore, it will be understood that the door positioning system 60, 60' can be provided according to various embodiments. Further, various portions of various embodiments may be interconnected or interchanged to provide the door positioning member 60, 60' according to various embodiments and the various portions described according to various embodiments are not necessarily limited to those particular embodiments. Further, the door positioning system, according to various embodiments need not be interconnected between two different portions of the system 10. The door positioning system can be interconnected or extend from only a single portion. Also, the door positioning system can include a single flexible member. The single flexible member could interact with the door to hold it in a selected position, similar to various embodiments of the door positioning system 60, 60'. Thus the door positioning system, according to various embodiments, can include one or many pieces.

As discussed above, the ventilation system 10 may be installed in any appropriate structure. Therefore, the housing 20 generally includes an inlet side that may be covered with a second grate or grill 70. The second grate 70 may substantially span the airflow inlet area defined by the fan housing 20. The second grate 70 may assist in ensuring that no large objects enter the fan assembly 11 and cause damage thereto. Therefore, the second grate 70 may be used to assist in maintaining operability of the fan assembly 11. Nevertheless, it will be understood that the second grate 70 need not be necessary and may also be replaced with any appropriate structure that allows an airflow through the inlet side of the fan housing 20 and still protects the fan assembly 11.

In addition to the various portions described above, various methods and processes may be used to form various portions of the ventilation system 10. As discussed above, the fan housing 20 may be formed in any appropriate manner. For example, the fan housing 20 along with the doors 32, 34 and the door support structure 36 may be formed at a substantially single time. Various methods may be used to form the monolithic structure of the fan housing 20 the doors 32, 34, and the door support 36. Various other portions, including attachment members and the like may also be formed at the same time.

For example, a mold may be formed substantially defining the shape of the fan housing 20 including the door structures 32, 34 and the door support 36. The mold may then be used to form a monolithic structure 80 in any appropriate manner. The monolithic structure 80 may be formed using various methods and materials such as generally known fiberglass manufacturing methods. Specific methods or materials, such as cut fiberglass material may be positioned in the mold and later and an epoxy or fiberglass structure forming materials may be added or layered according to known production techniques. The layered material may then be hardened or cured according to various techniques to form the monolithic structure 80. Various types of fiberglass material and types of epoxy material may be used depending upon the selected characteristic to be in the final product. Also, generally known or selected pre-impregnated layers or materials, laminated structures, blow molding techniques, or the like may be used to form the monolithic structure 80.

Alternatively, various polymer materials may be injection molded to form the monolithic structure 80. For example, various appropriate polymers, such as polyethylene, polyvinyl, or other polymers may be injection molded to form the monolithic structure 80. Again, the selected polymer may depend upon the final environment for the monolithic structure 80, including the fan housing 20 and the doors 32, 34.

Also, it will be understood, that various metals or metal alloys may be used in a similar manner. For example, a mold may be formed in which the monolithic structure 80 may be cast. Alternatively, a selected mold or form may be used to form a single sheet of metal material, such as galvanized steel, to form the monolithic structure 80.

Regardless of the method or materials used to form the monolithic structure 80, it will be understood that the monolithic structure 80 may be used to form various portions of the ventilation system 10 at a substantially single time. As discussed above, the fiberglass method may be used to form a substantially rigid, durable, yet lightweight monolithic structure 80 which may then be used to form at least a portion of the ventilation system 10.

Figure 6:
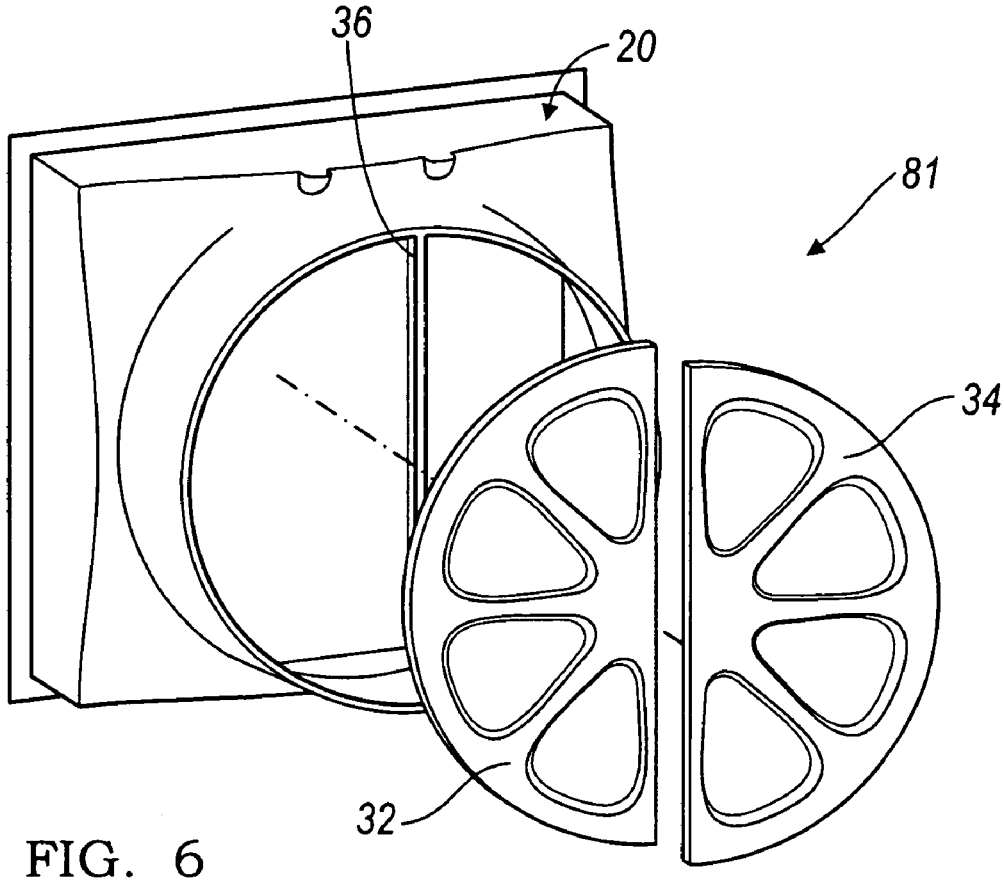
FIG. 6 is a perspective exploded view of the monolithic fan housing and back draft doors after trimming the doors to allow for movement according to various embodiments.

The monolithic structure 80 may be formed of appropriate materials, such as the fiberglass material, the metal or metal alloy material, or the polymer materials. The monolithic structure 80 can be cut into a separated or cut structure 81 so that the door structures 32, 34 can be substantially separated from a portion of the monolithic structure 80 such that they may move as illustrated in FIGS. 1 and 2. The door 32, 34 may be formed by at least partially separating them from other portions of the monolithic structure 80. For example, they may be cut around an exterior yet still held substantially intact at the door support structure 36, if the material allows the material from which the monolithic structure 80 is formed to act as a hinge. Alternatively, or in addition thereto, a hinge portion may be used to reconnect the door portions 32, 34 with the door support 36 if the doors are completely removed as illustrated in FIG. 6. Various hinge portions may then be used such as a pin, flexible member, or the like. Regardless, the door portions 32, 34 may be interconnected with the door support 36 to allow the door portions 32, 34 to move relative to the door support 36.

With reference to FIGS. 1, 2 and 3, the door portions 32, 34 may be held in a selected position depending upon a selected state of the ventilation system 10. The doors 32, 34 may be held in a closed position, such as in an initial position, when the fan assembly 11 is not on or operational, by a closing spring 90. The closing spring 90 may be affixed to the door 32, 34 in any appropriate manner such as with a tie ring or other fixation device 92. The closing spring 90 may also be interconnected with the door closing assembly or support post 36 in any appropriate manner such as with the holding ring or other fastener.

The closing spring 90 includes a spring force great enough to close the doors 32, 34 when the fan assembly 11 is not being operated. As discussed above, the fan assembly 11 is operable to move a volume of air at a selected rate through the ventilation system 10 in the diffuser 40. The volume of air is generally able to force the doors 32, 34 to an open position, such as that illustrated in FIGS. 1 and 2, regardless of the spring force of the closing spring 90. When the fan 11 is not operational, however, the spring force of the closing spring 90 will generally close the doors 32, 34.

Regardless when the doors 32, 34 attempt to move from the open to the closed position, it may be selected to have the doors in a substantially vertical position or at about a 90 degree angle relative to the closed position. If the door is in a more open position, such as at an angle greater than about 90 degrees, the spring force of the spring 90 may not be great enough to close the door 32, 34. In particular, if an external air flow source is causing air to flow relative to the door 32, 34, the spring force of the closing spring 90 may not be enough to close the door 32, 34.

Although it will be understood that each of the doors 32, 34 may include their own closing spring 90, only one is illustrated in FIG. 2 for clarity. Regardless, the spring force of the closing spring 90 is desired to be a substantially low spring force to allow the fan assembly 11 to move air at a selected flow rate past the doors 32, 34 at various speeds. Therefore, when a low flow rate is selected, the fan assembly 11 may operate at the low speed and, therefore, move a lower volume of air. Although the flow rate may be low it can still be selected to have the doors 32, 34 move to the substantially open position. Thus, the closing force of the closing spring 90 may be selected to be low. Thus, the door positioning system 60 may be provided to assist in limiting travel of the doors 32, 34. For example, as the doors 32, 34 move to substantially perpendicular or 90 degree angles relative to their closed positions, they may both engage the door positioning system 60.

The door positioning system 60 may include the door positioning member 62 that may have a small cross section such as about 0.01 inches to about 1 inch, such as about 0.2 inches. The small cross section of the door positioning member 62 may allow the doors 32, 34 to move substantially close to one another when in a fully open position. Nevertheless, it may be selected to make the door positioning member 62 substantially rigid so that fluctuations in the positioning member 62 do not move the doors 32, 34 independent of the air flow created by the fan system 11.

The positioning spring 66 may be interconnected with a selected portion, such as the grill 50 or the diffuser 40, may allow the door positioning member 62 to be moved with movement of the doors, 32, 34. As one skilled in the art will understand, various differences in air flow direction may cause the doors 32, 34 to remain in an open position yet move relative to the fan assembly 11. For example, the door may move to an angle greater than 90 degrees relative to the closed position depending upon air flow relative to the door 32 or 34. Because of the door positioning system 60, both of the doors 32, 34 may be maintained substantially near one another yet both of the doors may move substantially in tandem or mutually because of the door positioning member 60, 60', and/or the door positioning spring 66. Therefore, the door positioning spring 66 allows the door positioning member 62 to remain substantially between the two doors 32, 34 and move several degrees or inches depending upon movements of the doors 32, 34 for various reasons.

The mutual movements of the doors 32, 34 may allow for the doors to move to a substantially optimal position for air flow through the outlet 46 of the diffuser 40 such that a maximum or optimal air flow may be created by the ventilation system 10. The door positioning member 60, because it is able to move with the doors 32, 34, still allows the doors 32, 34 to be held substantially near one another and may assist in holding the doors 32, 34 in an open position. Because of the flow of air around the doors 32, 34, a vacuum or low pressure area may be formed between the doors 32, 34. This low pressure area may assist in holding the doors 32, 34 close together when they are in the open position and again allow for a maximum or optimal airflow. It will be understood that the air pressure differential is not intended to be limiting but is a proposed theory for assisting in opening or holding open the doors 32, 34, therefore, the present disclosure is not intended to be bound by the low pressure theory.

As discussed above, the doors 32, 34 may be interconnected with the fan housing 20 through any appropriate mechanism such as a separate hinge, a flexible portion of the monolithic structure 80, or a flexible member, or any appropriate design. Regardless, the door positioning assembly 60 may be used to allow the doors 32, 34 to be near one another, even if they move, when the fan assembly 11 is operated yet still allow the doors to remain close enough to the 90 degree position to allow the closing spring 90 to close the doors 32, 34.

Figure 7A:
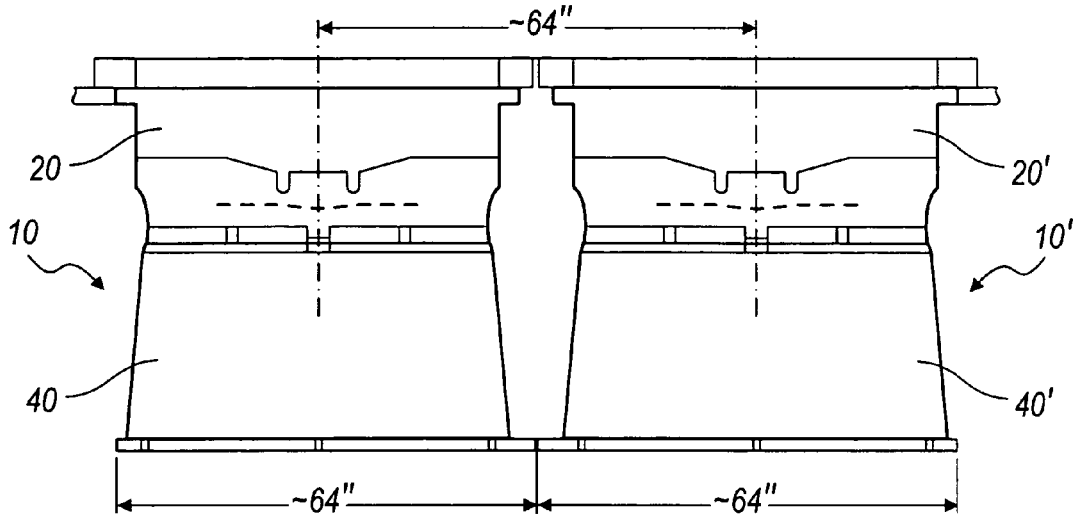
FIG. 7A is a top plan view of a pair of fan assemblies assembled and installed according to various embodiments.

With reference to FIGS. 1 and 7A-8B, two or more of the ventilation systems 10 may be installed relative to one another. For example, a first ventilation system 10 and a second ventilation system 10' may be installed substantially next to or adjacent to the first ventilation system 10. It will be understood that more than two ventilation systems 10 may be positioned relative to one another and a plurality may be provided in a selected structure. Regardless, the ventilation assemblies 10, 10' may be positioned in any appropriate dimensions. For example, as illustrated in FIG. 7A, the ventilation systems 10, 10' may be mounted at about 64 inches on center from one another. The fan blades 16 may be any appropriate length, such as defining a diameter of about 52 inches. Nevertheless, the fan housing 20 may generally include or define an external dimension of about 56 to about 57 inches. Nevertheless, it will be understood that both the fan diameter and the dimensions of the housing 20 may be any appropriate dimension. Regardless, the diffuser 40, 40' may include a dimension that is about 60 inches. It will be understood, however, as discussed above that the diffuser 40, 40' may be any appropriate diameter and about 64 inches is merely exemplary. Nevertheless, because of the ventilation systems 10, 10' are mounted about 64 inches from one another, the diffuser 40, 40' merely touch or are spaced apart at an edge and are substantially uncompressed due to the positioning of the ventilation systems 10, 10'.

Although the diffusers 40, 40' may be formed of any appropriate material, such as those described above, the material may be substantially rigid or generally flexible. The diffuser 40 may be formed of selected polymers such as high density polyethylene or any appropriate polymer material. As discussed above, the diffuser 40 may be formed in any appropriate method as well, such as injection molding, extrusion, or any appropriate method. Regardless, the diffuser 40, 40' is allowed to remain substantially uncompressed when mounted far enough from another diffuser. This allows the diffuser 40, 40' to include a maximum diameter which is greater than a dimension of the fan housing 20, 20'.

Figure 8A:
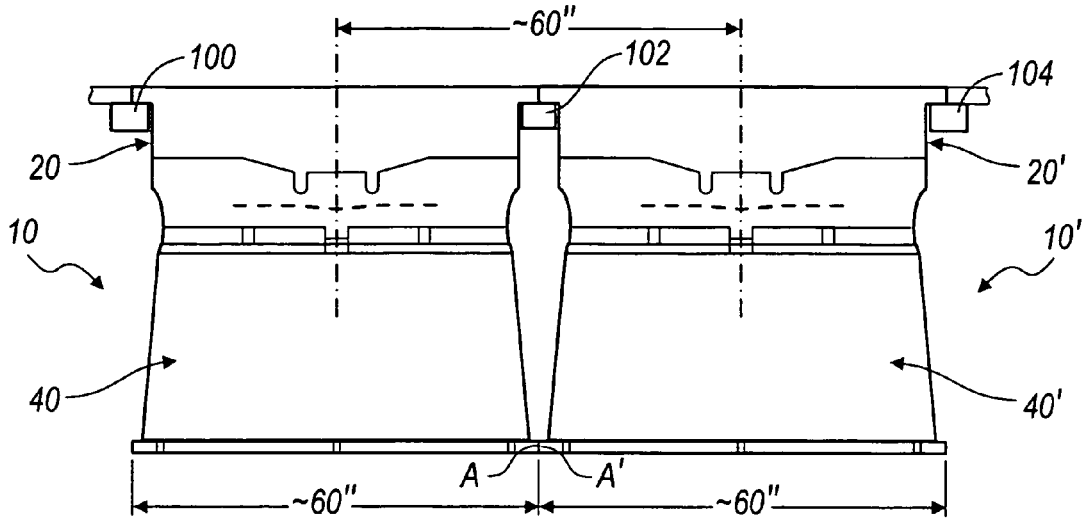
FIG. 8A is a top elevational view of a pair of fan assemblies assembled and installed according to various embodiments.

Although in various applications, the ventilation assemblies 10, 10' may be positioned closer to one another. For example, if a stud or wall support 100 is positioned relative to another stud 102 and another stud 104 at a dimension which does not allow the ventilation systems to be positioned at a great distance, the ventilation systems 10, 10' may be positioned closer to one another. As illustrated in FIG. 8A, the ventilation system 10, 10' may be positioned at about 60 inches on center. As discussed above, the fan blade may define a diameter of about 52 inches or any appropriate diameter. Therefore, the fan may be able to fit within the fan housing 20, 20' and still allow it to be positioned approximately 60 inches on center. Although the diffusers 40, 40' may still include a maximum diameter of about 64 inches, the material from which the diffusers 40, 40' are formed and the orientation and/or configuration of the grill 50 may allow them to flex.

Therefore, positioning the ventilation systems 10, 10' closer to one another may allow the ventilation system 10, 10' to be installed in many applications and/or areas without providing a plurality of the sizes of the diffusers 40, 40'. The generally flexible material of the diffusers 40, 40' allows a depression A or A' to be formed in the respective diffusers 40, 40' to allow the ventilation assemblies 10, 10' to positioned close to one another without using a different diffuser.

Figure 7B:
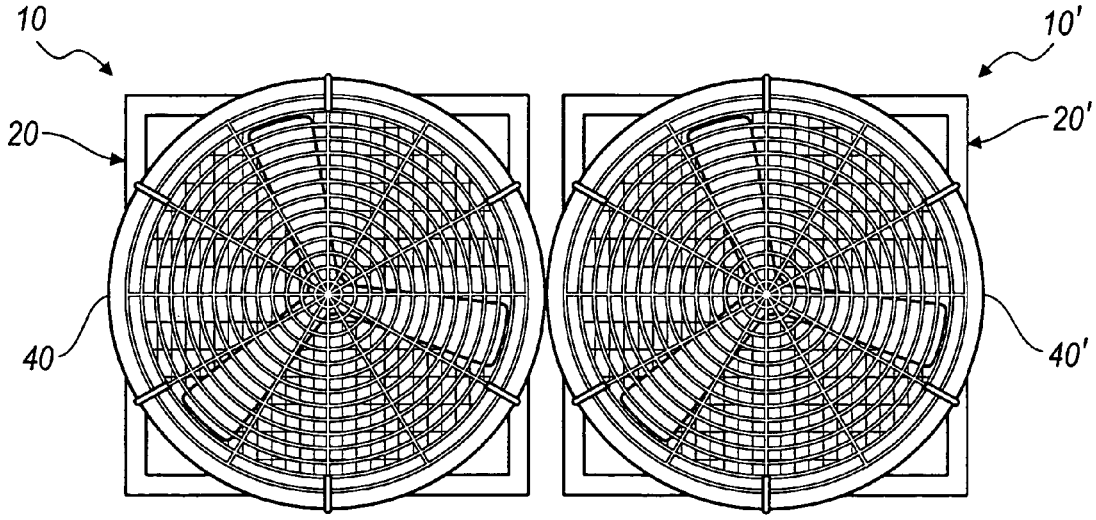
FIG. 7B is a elevational view from the outlet side of the fans illustrated in FIG. 7A.

As discussed, the diffuser 40, 40' may be formed substantially integrally with the fan housing 20, 20' or separate therefrom. Regardless, the flexible material may allow the diffuser 40, 40' to be used in any application regardless of size of the area to which the fan housing 20, 20' is installed. Rather than providing a plurality of the sizes of the diffusers 40, 40' substantially a single diffuser size may be provided. This may be done to allow for optimal airflow when space allows, such as illustrated in FIGS. 7A and 7B and still allows for an adequate airflow when deformation of the diffusion 40, 40' is required such as illustrated in FIGS. 8A and 8B.

Figure 8B:
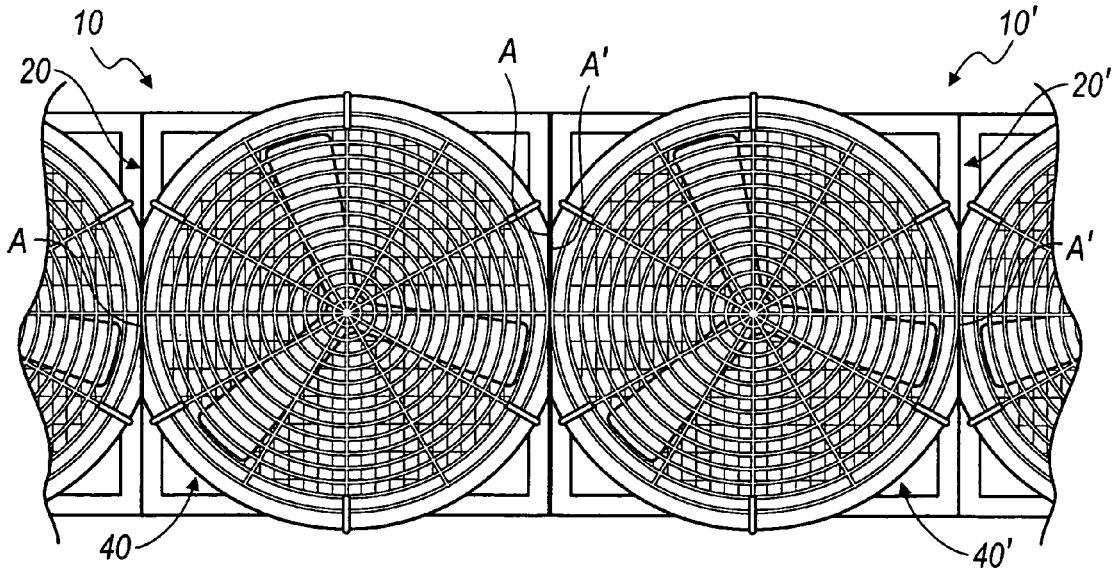
FIG. 8B is an elevational view from an outlet side of the fans of FIG. 8A.
Figure 9:
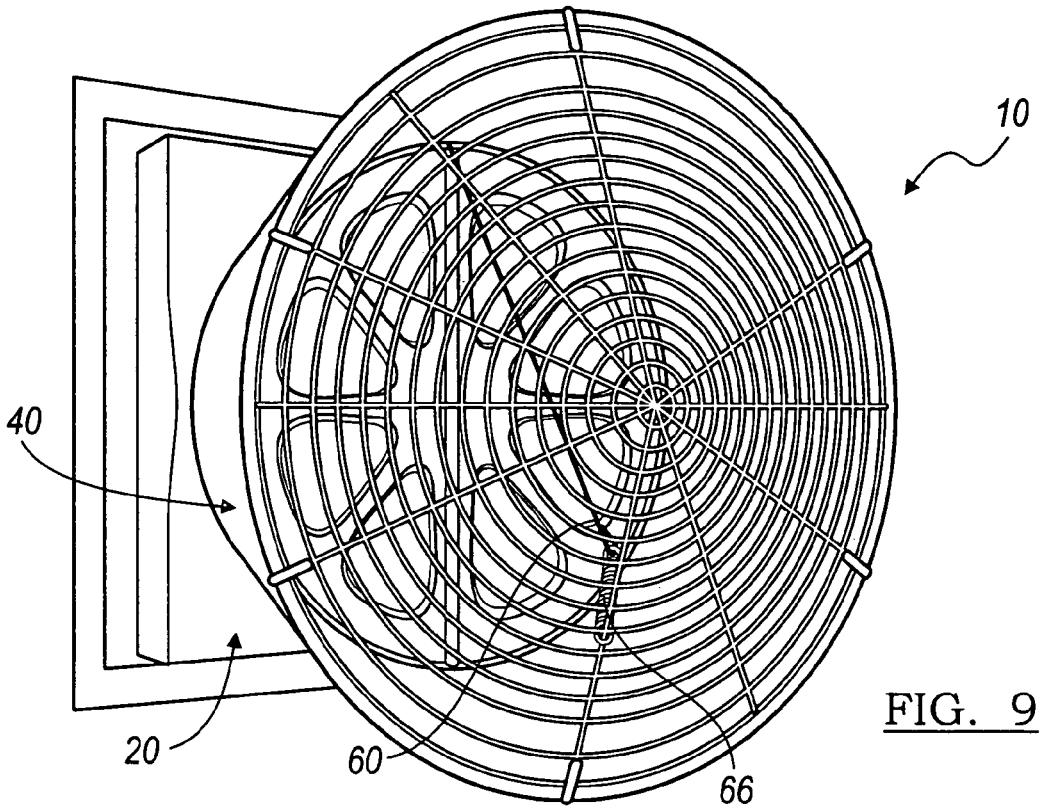
FIG. 9 is a perspective view of a ventilation system with a door system closed according to various embodiments.
Figure 10:
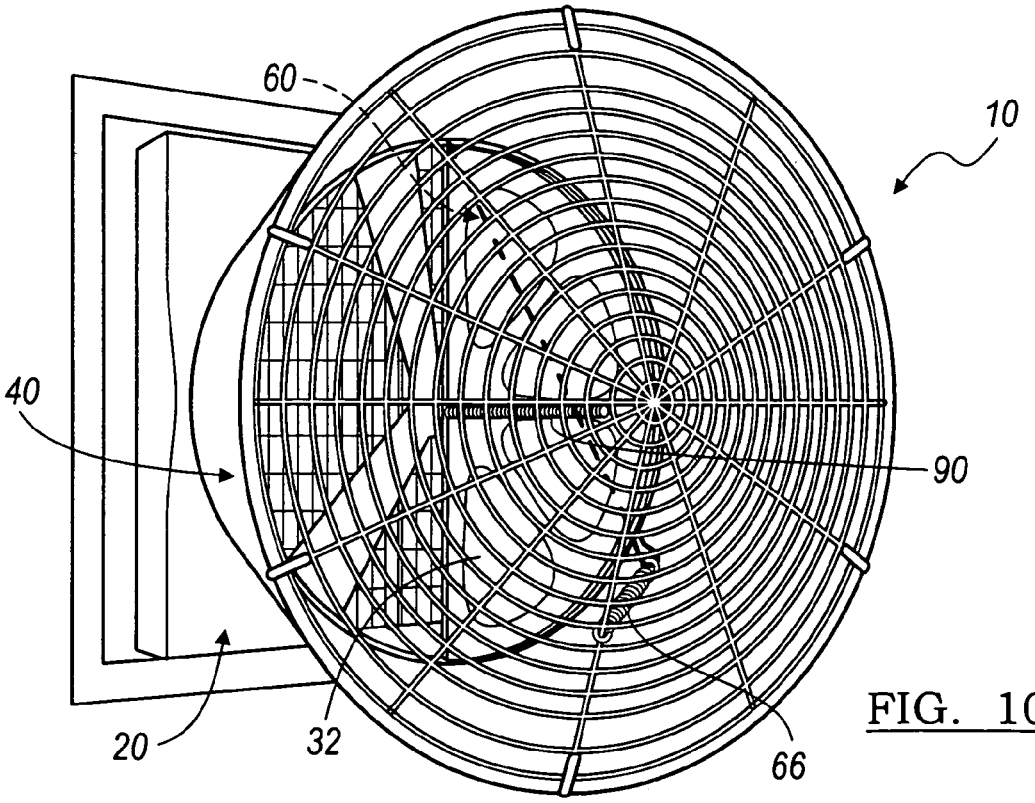
FIG. 10 is a perspective view of a ventilation system with a door system open according to various embodiments.
Figure 11:
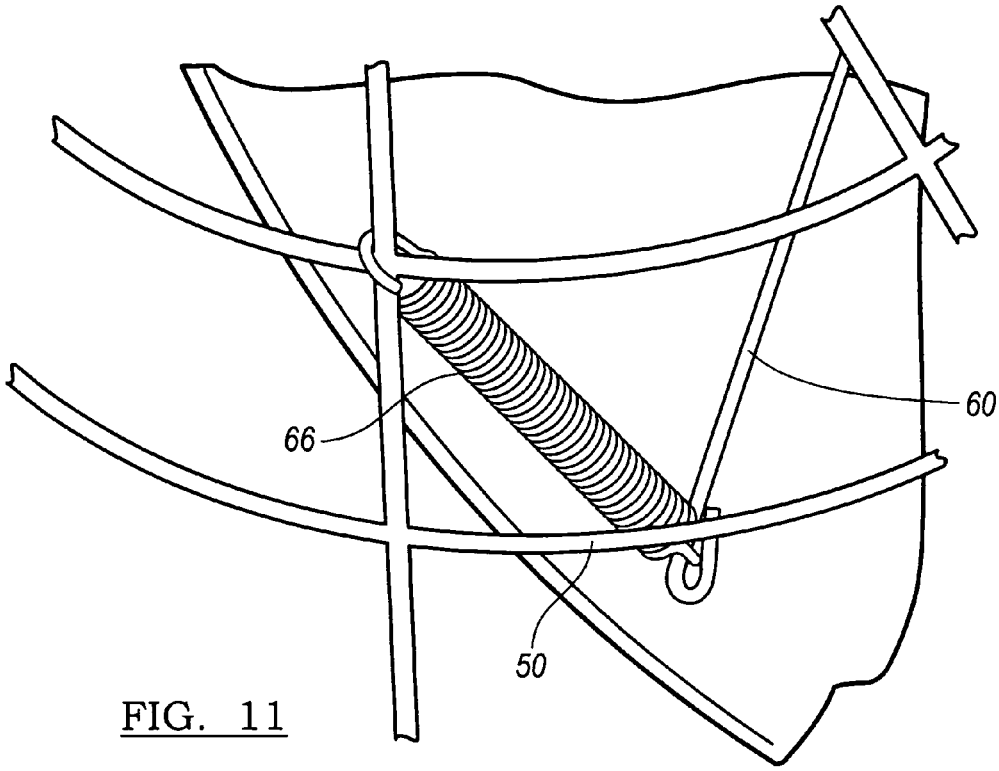
FIG. 11 is a detail perspective view of a ventilation system with a door positioning system according to various embodiments.
Figure 12:
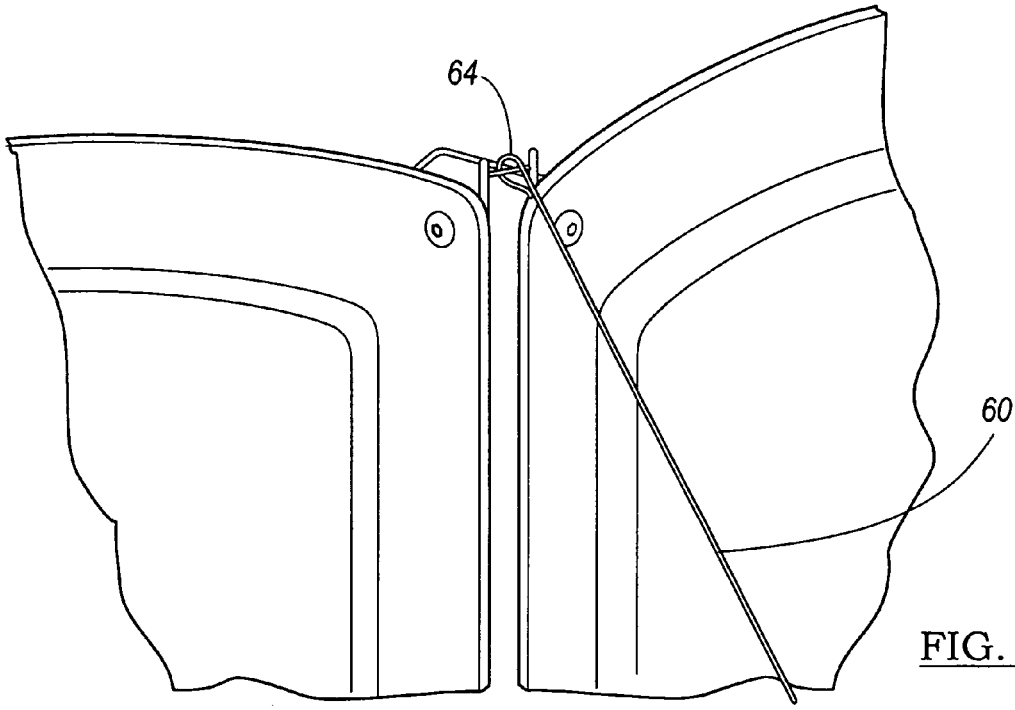
FIG. 12 is a detail perspective view of a ventilation system with a door positioning system according to various embodiments.
Figure 13:
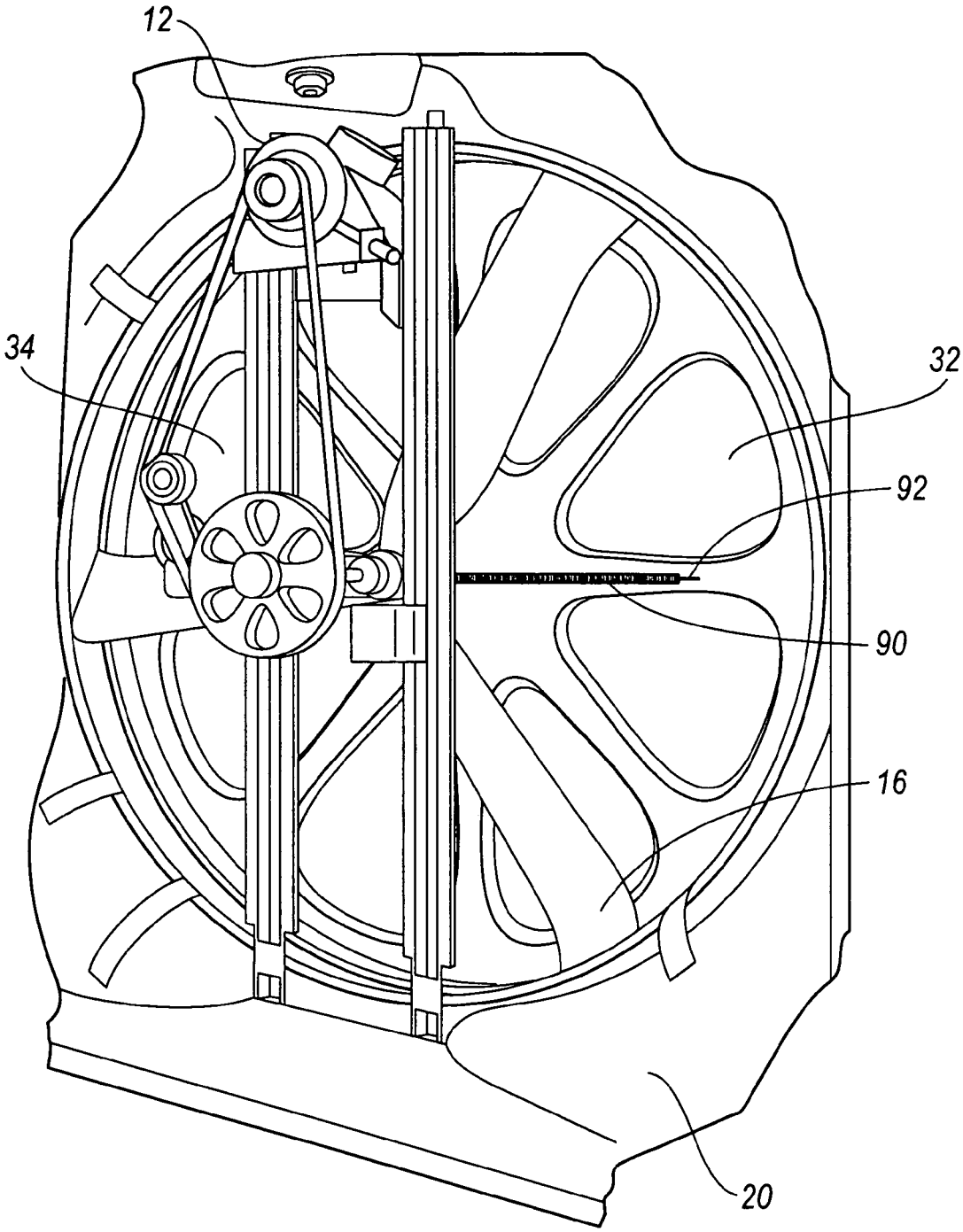
FIG. 13 is a perspective view of a ventilation system with a door system closed from an upstream position according to various embodiments.
Figure 14:
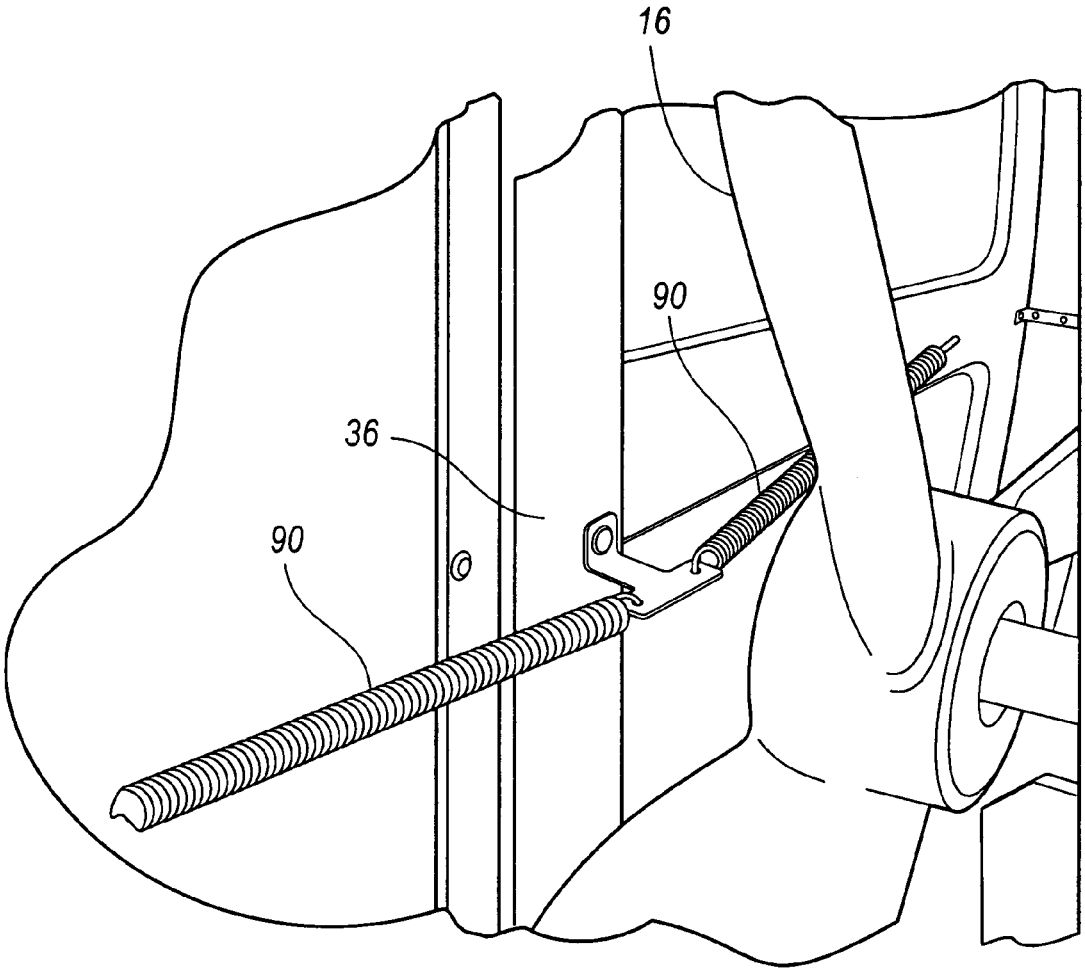
FIG. 14 is a detail perspective view of a ventilation system with a door system closed from an upstream position according to various embodiments.

As exemplary illustrated in FIGS. 8A and 8B each of the diffusers 40,40' can deform at least about four inches even with the grate 50 installed. It will be understood that the diffusers 40, 40' can deform on more than one side if a fan assembly is on both sides, but it will be understood that the diffuser can deform on only one portion. Although any appropriate amount of deformation can be allowed for formed. The deformation can allow for a single assembly to be installed in a plurality of applications and spacings. Further, the grate 50 can be formed and provided so that it does not need to be altered during installation to allow for the selected deformation.

Although the diffuser 40 may be flexible, the fan housing 20 may also be flexible. Thus the fan housing 20 may have a standard or selected size, but is able to fit into many different applications. For example, farmhouses may be built according to different plans to have stud walls or supports positioned at different spacing. Thus the flexible fan housing 20 may be able to flex and fit into several spacing. Thus, the flexible housing 20 and/or the flexible diffuser 40 allows one or fewer sizes to be made and still fit in various applications. Though the portions may be made flexible for any purpose, and spacing and positioning is merely exemplary.

Therefore, the ventilation system 10 may be provided in any appropriate application, such as venting a farmhouse. The fan housing 20 may be formed substantially monolithically with various portions that later disconnect, in part or in whole, from the fan housing to be used therewith. The ventilation system 10 may also include a door positioning system which allows for positioning the doors in an appropriate position for substantially maximum airflow while maintaining the doors in an appropriate position to allow for closing at a selected time. Further, various materials and methods may be used to form the diffuser 40 in a substantially flexible manner to allow for each of positioning the diffuser 40 for installation. Further, the diffuser 40 may be formed in a substantially single size for installation in a plurality of locations.

It will be understood that the fan assembly 11 with the ventilation system 10 may be operated in any appropriate manner. The fan assembly 11 may substantially be manually operated such that an individual may be required to manually turn the fan assembly 11 on and off at a selected time. Alternatively, the fan assembly 11 may be operated by an on-site electronic sensor and/or processor system to monitor selected characteristics of a building, such as a farmhouse, and determine whether a selected characteristic is being met, such as an oxygen concentrate, a carbon dioxide concentration, a temperature or other appropriate specifications. Further, the fan assembly 11 may be operated substantially remotely through various connections, such as internet connections, wireless connections, wired connections or the like, and can be monitored for various specifications in the farmhouse and operated accordingly. Further, the fan assembly 11 of the ventilation system 10 may be operated based on a time based system or other appropriately operating system.

Various appropriate systems may include the Chore-Tronic™ system sold by CTB Inc. of Indiana or the control systems disclosed in U.S. patent application Ser. No. 10/674,282, filed Sep. 28, 2003, incorporated herein by reference, and U.S. patent application Ser. No. 10/914,682, filed Aug. 9, 2004, incorporated herein by reference. Regardless, the ventilation system 10 may be operated according to any appropriate manner to achieve selected results. The various structures and formations of the ventilation system 10 may also be formed as discussed above to achieve selected results.

The teachings herein are merely exemplary in nature and, thus, variations that do not depart from the gist of the teachings are intended to be within its scope. Such variations are not to be regarded as a departure from the spirit and scope of the teachings.

What is claimed is:

1. A ventilation system, comprising:

a housing member having a front face cross-section plane;

a fan system operable to move a volume of gas downstream positioned relative to said housing member;

a first door and a second door extending from a first portion of said housing member and downstream of the fan system; and a door positioning member extending between a first end and a second end, wherein the first end is connected at the first portion of the housing that is upstream of the second end that is connected to a structure downstream of the first portion;

wherein the door positioning member is operable to allow the first door and the second door to move near one another;

wherein the door positioning member is operable to move with the first and second door while they are near one another and allow a selected movement of at least one of the first door or the second door, while near one another, passed 90 degrees relative to the front face cross-section plane of the housing member.

2. The ventilation system of claim 1, wherein the housing member, the first door and the second door are formed of a single member such that the first door and the second door substantially cover an opening on the housing member formed by removing them from the single member.

3. The ventilation system of claim 2, wherein at least one of the first door, the second door, or combinations thereof are cut from the single member and hingedly affixed to the housing member.

4. The ventilation system of claim 2, wherein at least one of the first door, the second door, or combinations thereof are at least partially cut from the housing member to hingedly move relative to the housing member.

5. The ventilation system of claim 1, wherein the door positioning member is selected from at least one of a rigid member, a flexible member, a sectioned member, or combinations thereof.

6. The ventilation system of claim 5, wherein the door positioning member includes a flexible connection member.

7. The ventilation system of claim 6, further comprising a diffuser extending from said housing member.

8. The ventilation system of claim 7, wherein the flexible connection member is connected to the diffuser.

9. The ventilation system of claim 1, further comprising:

a controller;

wherein the controller is operable to control the operation of the fan system.

10. The ventilation system of claim 1, wherein the door positioning member is operable to maintain the first door and the second door next to one another during operation of the fan system.

11. A method of ventilating an area with a ventilation system having a fan system positioned relative to a housing with at least a first door and a second door extending from a portion of the housing, comprising:

providing a housing to define a first cross-sectional area;

selectively covering at least a portion of the first cross-sectional area with the first door and the second door;

operating the fan system to selectively move a volume of gas downstream and move the first door near the second door a selected amount;

connecting a first portion of a door positioning member to a first portion of the provided housing;

extending the door positioning member between the first door and the second door;

connecting a second portion of the door positioning member to a structure downstream of the first portion;

allowing the first door to remain near the second door and move relative to the provided housing with the door positioning member between the first door and the second door;

allowing movement of the first door and the second door with the door positioning member between the first door and the second door for at least a portion of a range of motion of the first door or the second door; and positioning the first door or the second door with the door positioning member whereupon ceasing operation of the fan system, both of the first door and the second door are operable to be closed.

12. The method of claim 11, further comprising forming the housing and forming the first door and the second door together as a monolithic member.

13. The method of claim 12, wherein forming the first door and the second door includes cutting at least a portion of the first door and the second door from the monolithic member.

14. The method of claim 11, further comprising:

providing a hinge; and hingedly moving the door.

15. The method of claim 11, further comprising:

providing a door closing system operable to move the door to a closed position at a selected time.

16. The method of claim 11, wherein positioning the first door and the second door includes substantially limiting movement of the first door and the second door relative to the housing to a maximum position that is substantially parallel with a plane of movement of the gas by the fan system and greater than 90 degrees to a plane defined by the first cross-sectional area.

17. The method of claim 11, further comprising providing a diffuser extending from the provided housing.

18. The method of claim 17, further comprising:

providing a first housing and first diffuser and a second housing and a second diffuser:

positioning the first housing and the first diffuser relative to the second housing and the second diffuser; and at least partially deforming the first diffuser, the second diffuser, or combinations thereof.

19. The method of claim 11, further comprising selectively operating the fan system.

20. The method of claim 11, wherein forming the housing includes injection molding, extrusion molding, fiberglass molding, casting, stamping, or combinations thereof.

21. The method of claim 11, wherein the first door and the second door move within a selected range of movement allows at least one of the first door or the second door to open more than 90 degrees while near the other of the first door or the second door.

22. A method of providing a ventilation system to a structure, the method comprising:

providing a first ventilation housing having a first flexible diffuser;

providing a second ventilation housing have a second flexible diffuser;

mounting the first ventilation housing near the second ventilation housing within a structural element of the structure;

selecting a non-zero amount of deformation of at least one of the first flexible diffuser, the second flexible diffuser, or combinations thereof;

wherein selecting the amount of deformation includes the positioning of the first flexible diffuser near the second flexible diffuser at the structure so that the first flexible diffuser deforms the second flexible diffuser, the second flexible diffuser deforms the first flexible diffuser, or the first and the second flexible diffuser both deform each other when fixed to the structure.

23. The method of claim 22, providing a grate over a portion of the first diffuser or the second diffuser;

wherein the provided grate has an exterior dimension less than an interior dimension of the first diffuser or the second diffuser and is operable to allow the selected amount of deformation;

wherein providing a grate includes providing a first grate for the first diffuser and providing a second grate for the second diffuser.

24. The method of claim 22, further comprising positioning the first ventilation housing, the second ventilation housing, or combinations thereof in a structure.

25. The method of claim 22, wherein selecting an amount of deformation of at least one of the first flexible diffuser, the second flexible diffuser, or combinations thereof includes selecting at least four inches of deformation of at least one of the first flexible diffuser, the second flexible diffuser, or combinations thereof.

26. A ventilation system, comprising:

a housing perimeter defining a first cross-sectional area;

a housing face member defining a second cross-sectional area and having a door connection region;

a door assembly including a first door member and a second door member connected to the door connection region, wherein the first door member and the second door member are substantially equal in area to the second cross-sectional area;

a door positioning system having a member having a first end connected near the door connection region and a second end connected downstream of the door connection region; and a fan selectively operable to move a volume of gas through the housing face in a downstream direction;

wherein the fan is positioned relative to the housing perimeter;

wherein the door positioning system is operable to allow the first door member to move to a selected position substantially parallel to the second door member and allow the first door member to remain in the selected position substantially parallel to the second door member as the first door member and the second door member move during operation of the fan;

wherein the door positioning system allows the first door member and the second door member to move to a position wherein at least one of the first door member and the second door member is at an angle greater than 90 degrees to a plane defined by the second cross-sectional area and obstructs the motion of either of the doors from moving to a position to allow the first door member and the second door member to return to a closed position with a door closing system.

27. The ventilation system of claim 26, wherein the door connection region is adjacent a hinge for the door.

28. A method of forming a ventilation system, comprising:

forming a one-piece housing member having, a housing perimeter defining a first cross-sectional area, a housing face defining a second cross-sectional area, and door members and a door support which together are substantially equal in area to the second cross-sectional area;

removing the door members from the one-piece housing member;

moveably attaching the removed door members to the remainder of the one-piece housing member; and positioning a fan to selectively move a volume of gas downstream past the door members.

29. The method of claim 28, further comprising:

forming a first door and a second door of the removed door members;

moving the first door and the second door from a closed position;

moving the first door to a selected position substantially parallel relative to the second door;

moving both the first door and the second door within a selected range of movement during operation of the fan while the first door remains in the selected position substantially parallel relative to the second door as the first door and the second door move;

limiting a maximum movement of either the first door or the second door with a door positioning system, whereupon cessation of the movement of the gas, both of the first door and the second door return to a closed position.

30. The method of claim 29, wherein the one piece member is formed by at least one of injection molding, extrusion, fiberglass molding, casting, stamping, blow molding, or combinations thereof.

31. The method of claim 29, further comprising:

positioning a door positioning member between the first door and the second door at least when the first door is substantially parallel to the second door.

32. The method of claim 31, wherein the door positioning member includes a rigid member, a flexible member, a sectioned member, or combinations thereof.

33. The method of claim 31, wherein positioning the door positioning member includes connecting an elongated and thin member extending between the first door and the second door from the housing face.

34. The method of claim 29, further comprising:

closing both the first door and the second door with a door closing system connected directly to at least one of the first door and the second door;

wherein limiting a maximum movement ensures that the door closing system closes the first door and the second door when movement of the volume of gas ceases.

35. The method claim 28, further comprising:

providing a diffuser including a minimum third cross-sectional area equal to the second cross-sectional area; and connecting a diffuser to extend from the housing face.

36. The method of claim 35, further comprising:

providing a second diffuser extending from the housing face; and selectively deforming at least one of the diffuser and the second diffuser with the other of the diffuser or the second diffuser a non-zero amount.

37. The method of claim 28, further comprising:

hingedly connecting the door members to at least a portion of the housing face;

wherein the door members are operable to move between a closed position and an open position.

38. The method of claim 37, wherein hingedly connecting the door member includes providing a hinge member at least partially separate from the doors, the housing face, or combinations thereof.

* * * * *

UNITED STATES PATENT AND TRADEMARK OFFICE

CERTIFICATE OF CORRECTION

PATENT NO. : 7,611,403 B2
APPLICATION NO. : 11/273341
DATED : November 3, 2009
INVENTOR(S) : Curtis Wenger It is certified that error appears in the above-identified patent and that said Letters Patent is hereby corrected as shown below:

Column 10, line 49 claim 1: delete "passed" and replace with "past"

Column 14, line 43 claim 38: delete "member" (first occurrence) and replace with "members"

Signed and Sealed this

Twenty-eighth Day of September, 2010

David J. Kappos

David J. Kappos
*Director of the United States Patent and Trademark Office*